US005305965A

United States Patent [19]

Yamada et al.

[11] Patent Number: 5,305,965

[45] Date of Patent: Apr. 26, 1994

[54] APPARATUS FOR WINDING AND STORING A TAPE-LIKE ARTICLE IN A CONTAINER

[75] Inventors: Yasuo Yamada; Masaaki Fuda, both of Toyama, Japan

[73] Assignee: Yoshida Kogyo K.K., Tokyo, Japan

[21] Appl. No.: 810,144

[22] Filed: Dec. 19, 1991

[30] Foreign Application Priority Data

Dec. 21, 1990 [JP] Japan ..... 2-412591

[51] Int. Cl.[5] ..... B65H 18/10

[52] U.S. Cl. ..... 242/56 R; 226/92; 242/78.1

[58] Field of Search ..... 242/78.1, 78.3, 78.8, 242/56 R, 57, 56.1, 67.1 R, 67.2; 226/91, 92

[56] References Cited

U.S. PATENT DOCUMENTS

| | | | |
|---|---|---|---|
| 4,003,112 | 1/1977 | Miller et al. | 242/56.1 X |
| 4,674,697 | 6/1987 | Filter et al. | 242/78.8 X |
| 4,738,408 | 4/1988 | Odaka et al. | 242/56 R X |
| 4,747,553 | 5/1988 | Ogawa | 242/56 R |
| 5,110,063 | 5/1992 | Koepe | 242/78.1 |

FOREIGN PATENT DOCUMENTS

| | | |
|---|---|---|
| 0202591 | 11/1986 | European Pat. Off. . |
| 1652605 | 1/1968 | Fed. Rep. of Germany . |
| 1906643 | 9/1969 | Fed. Rep. of Germany . |
| 1499018 | 10/1969 | Fed. Rep. of Germany . |
| 2165499 | 7/1973 | Fed. Rep. of Germany . |
| 2109776 | 6/1983 | United Kingdom . |

*Primary Examiner*—Daniel P. Stodola
*Assistant Examiner*—Paul T. Bowen
*Attorney, Agent, or Firm*—Hill, Steadman & Simpson

[57] ABSTRACT

An apparatus for winding and storing a tape-like article in core-less form in a container is disclosed. The tape-like article is fed along a movable guide member, being inserted into a center of the container through an opening on a side wall of the container, and being caught by a grip of a spindle inserted via a through hole on a side of the container. When the tape-like article is wound around the spindle to a preset length, the tape-like article is cut, and the spindle is released from the container.

7 Claims, 5 Drawing Sheets

APPARATUS FOR WINDING AND STORING A TAPE-LIKE ARTICLE IN A CONTAINER

BACKGROUND OF THE INVENTION

1. Field of the Invention

This invention relates to a method of storing, in wound form, a tape-like article, such as a surface fastener, a slide fastener tape, a slide fastener chain, a garment belt and a decoration tape, in a container, and an apparatus for winding and storing such tape-like article in the container.

2. Description of the Related Art

For transportation, a tape-like article is usually wound around a spool as disclosed in Japanese Patent Laid-Open Publication Sho-287646 (1986).

The tape-like article (hereinafter called "tape") is automatically wound around the spool. Since the outermost layer of the wound tape is however exposed on the spool, the tape may be stained or damaged. Sometimes the tape may stick out from the spool, thereby deteriorating its packaged appearance. Further, since opposite ends of a spool shaft project from the centers of disc flanges, a number of spools are difficult to stack neatly. For these reasons, there are great demands for storing wound tapes in containers.

To store the tape in a container, the tape has to be manually wound and be placed in the container, which may reduce throughput of the tapes.

SUMMARY OF THE INVENTION

It is therefore an object of this invention to provide a method of automatically winding a tape-like article without using a core and storing the tape-like article in a container.

Another object of this invention is to provide an apparatus for winding and storing such tape-like article in a container.

According to a first aspect of this invention, there is provided a method of winding and storing a tape-like article in a container, comprising: positioning a container having a through hole at the center of at least a front or rear surface thereof and having an opening on one of side walls to face a tape supply unit; inserting a leading edge of the tape-like article into the container through the opening to cross the through hole; inserting a spindle into the container to catch the leading edge of the tape-like article; rotating the spindle to wind the tape-like article therearound in the container; stopping the spindle upon detection of the tape-like article wound to the preset length; cutting the tape-like article; releasing the spindle from the tape-like article; and removing the spindle from the container.

According to a second aspect of this invention, there is provided an apparatus for winding and storing a tape-like article in a container, comprising: a tape supply unit including at least one feed roller and a cutter for feeding and cutting a tape-like article; a guide member for guiding the tape-like article, the guide member being axially and movably connected to the tape supply unit via an upper portion thereof and including a guide piece which is slidable in the moving direction of the guide member; a holder for supporting the container having a through hole on at least a front or rear surface and an opening on one of side walls, the holder being positioned so that the opening of the container is kept within a moving path of a lower end of the guide member; a first driving unit connected to the guide member to reciprocate a lower end of the guide member between a standby position D outside the container and a work position E where the lower end reaches the center of the container through the opening; a second driving unit connected to the guide member to reciprocate the guide piece of the guide member between the work position E and the position G where the guide piece crosses the center of the container; a spindle located at a position corresponding to the through hole of the container supported on the holder, the spindle being reciprocated between a standby position outside the container and a position for winding the tape-like article thereon in the container through the opening, and including a grip for catching the tape-like article on the guide piece of the guide member when the spindle is at the tape winding position; and a third driving unit for rotating the spindle when the guide piece withdraws to a position where the guide piece does not interfere with the spindle, and for stopping the spindle when the tape-like article is wound to a preset length.

According to a third aspect of this invention, the second driving unit determines a stop position where the guide piece is always in contact with an outermost layer of layers of the tape-like article on the spindle without interfering with the spindle, a detector is connected to the guide member to detect a moving angle of the guide member in accordance with increase of a diameter of the tape layers, and the third driving unit includes control means for controlling the rotation speed of the spindle, according to a result detected by the detector, to apply a substantially uniform tension to the tape-like article.

DETAILED DESCRIPTION

Figure 1:
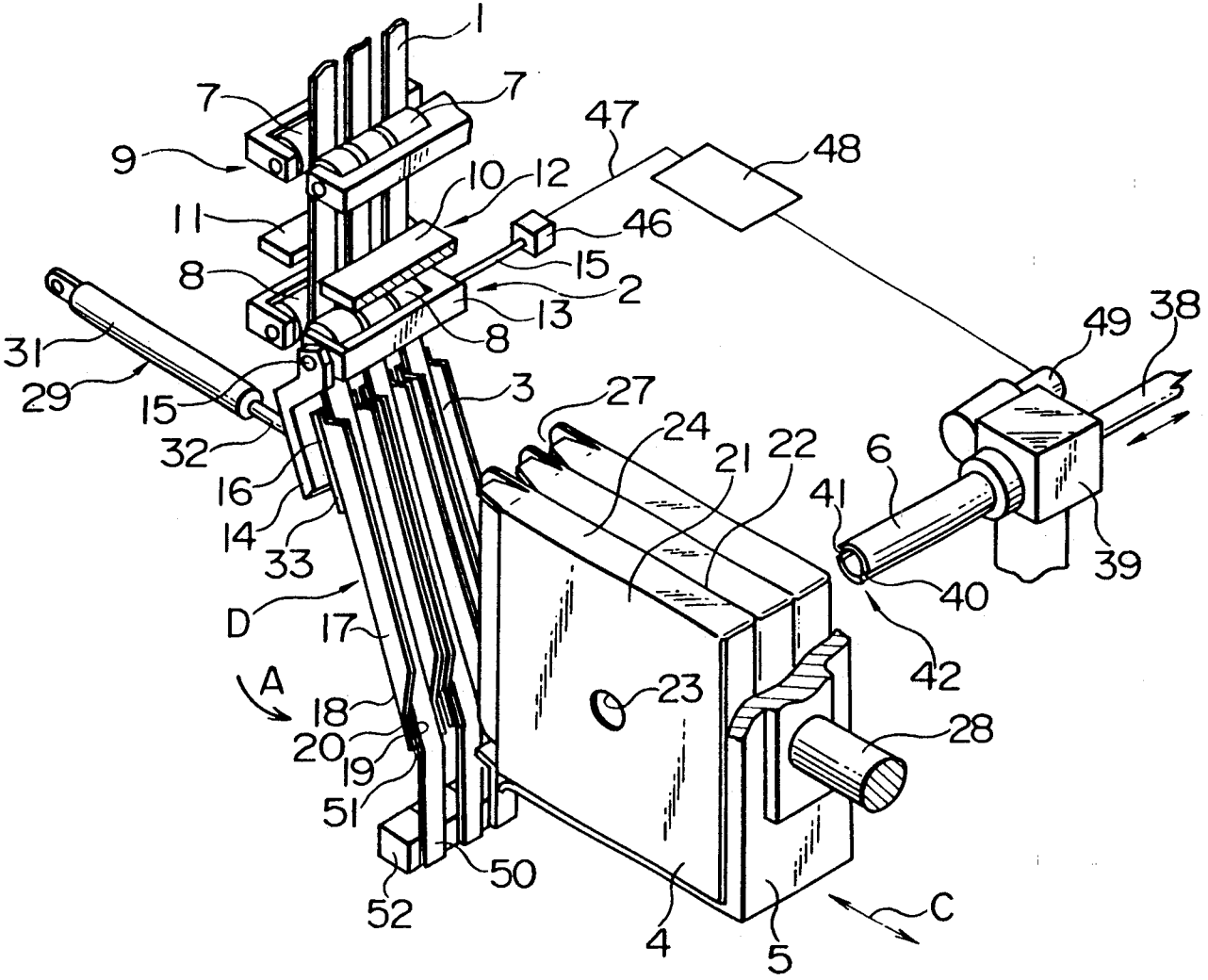
FIG. 1 is a perspective view of an apparatus for winding and storing a tape in a container according to one embodiment defined in claim 2 of this invention.

One embodiment of this invention will be described with reference to FIGS. 1 to 6. As shown in FIG. 1, an apparatus for winding and storing a tape 1 mainly comprises a tape supply unit 2, a guide member 3, containers 4, a holder 5, and a spindle 6 for taking up the tape 1.

The tape supply unit 2 includes a tape feeder 9 having groups of feed rollers 7, 8, and a cutter 12 having a punch 10 and a cut-off die 11. The tape feeder 9 stops operation according to a detection signal indicating that a tape has been wound to a preset length in a container 4. Then the cutter 12 cuts the tape 1.

A rocking plate 14 is axially and movably mounted at the downstream of the tape supply unit 2, i.e. a frame 13 for the feed roller group 8 via a shaft 15. The guide member 3 is coupled to the rocking plate 14 to be slidable in the longitudinal direction.

In FIG. 1, the guide member 3 includes three conduits 17 for feeding three tapes at a time. The number of the conduits 17 is not however limited to three.

The guide member 3 is formed with a thin guide piece 20 having tape guiding grooves 19.

The guide piece 20 of FIG. 1 is integral with the lower end 18 of the conduit 17. The guide piece 20 may be formed as a separate member to be attached to the lower end 18 of the guide member 3. The tape guiding grooves 19 may be dispensable.

The holder 5 is positioned in front of the guide member 3 so that the lower end 18 of the guide member 3 enters, along a path shown by a double-arrow B, into the container 4 through the opening 27.

Figure 2:
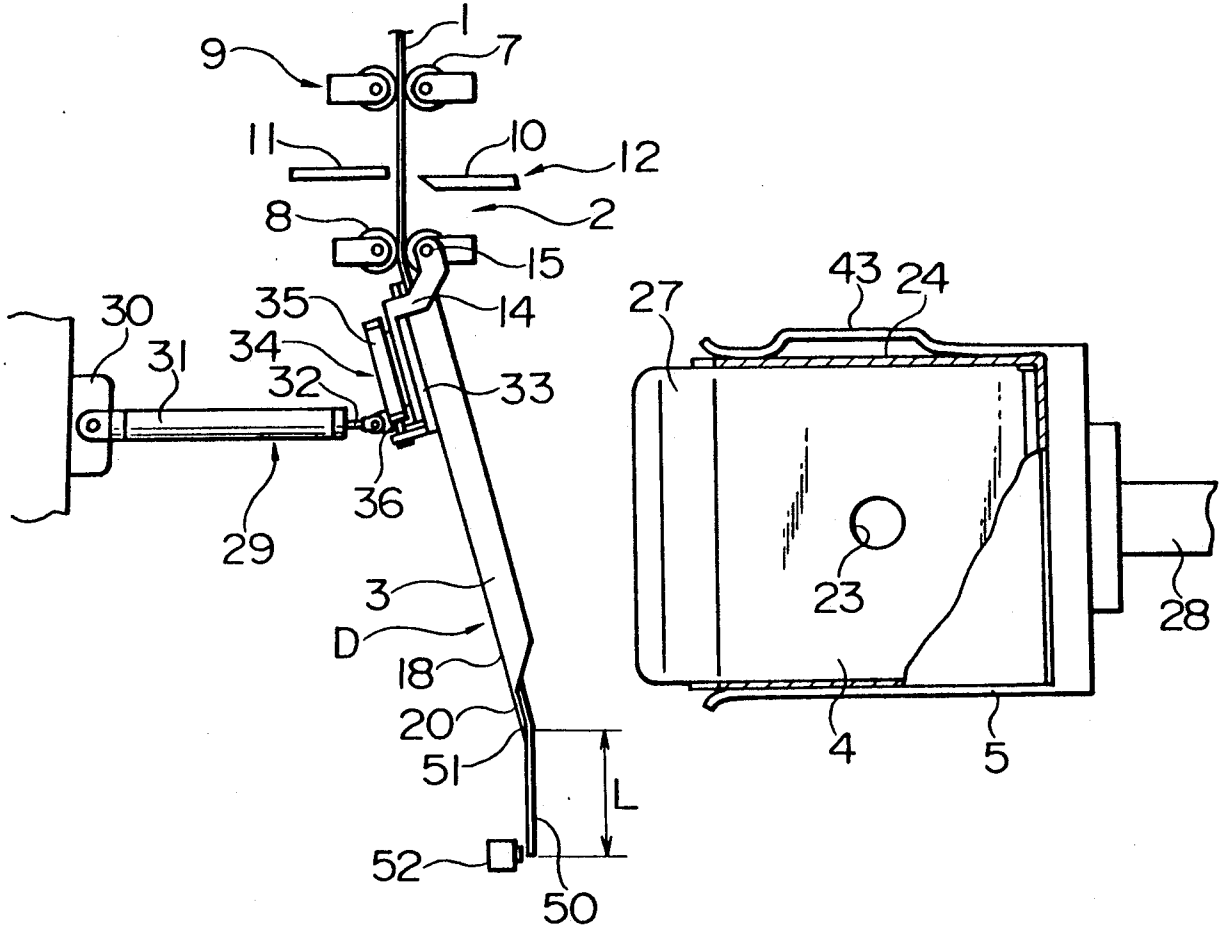
FIG. 2 is a side elevational view, partly a cross-sectional view, of the apparatus of FIG. 1.
Figure 7:
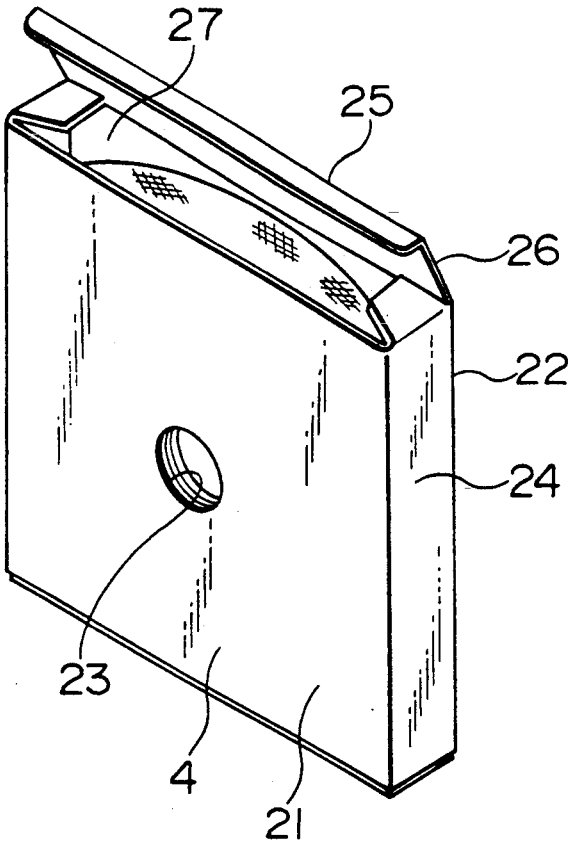
FIG. 7 is a perspective view of a container in which the tape stored in the wound form.

As shown in FIGS. 1, 2 and 7, the container 4 is a flat square-shaped box having a through hole 23 at the centers of its front and rear sides. One of side walls 24 serves as a lid 26 having a flap 25, forming an opening 27.

The holder 5 is positioned in front of the guide member 3 so that the lower end 18 of the guide member 3 enters, along a path shown by a double-arrow B, into the container 4 through the opening 27. The holder 5 is connected to an end of a movable rod 28 of a fluid pressure cylinder or the like (not shown), being reciprocated as shown by an arrow C between the positions shown in FIG. 1 to 3, and a position for receiving empty an container. In FIG. 2, reference numeral 43 stands for a spring for holding the container 4.

Figure 3:
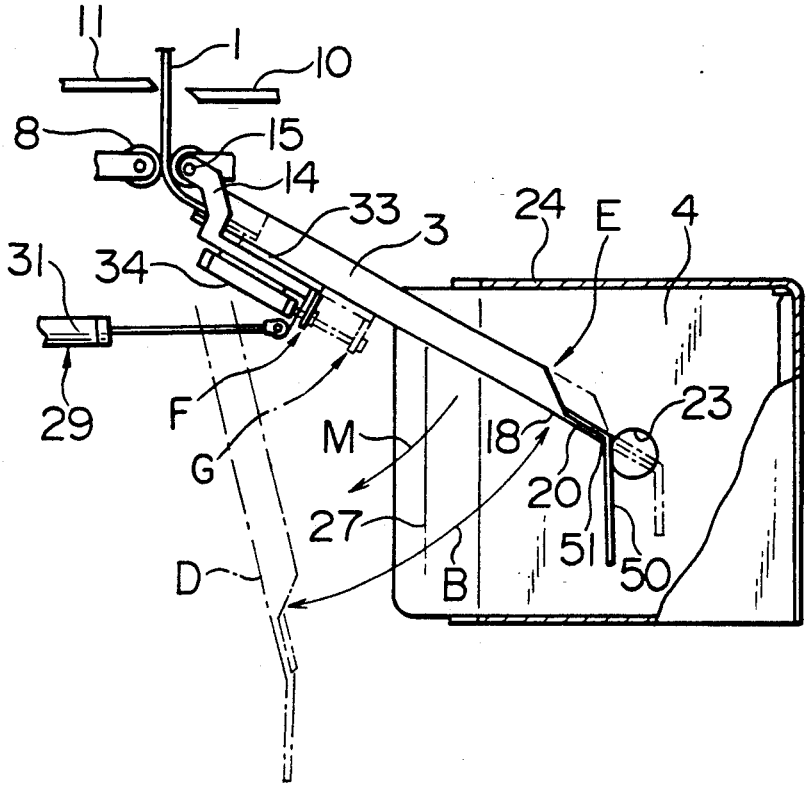
FIG. 3 is a view similar to FIG. 2, showing the initial operation stage of the apparatus.

A first driving unit 29 is connected to the rocking plate 14 so that the lower end 18 of the guide member 3 is reciprocated between the standby position D outside the opening 27 of the container 4 (shown in FIGS. 1 and 2) and the work position E where the lower end 18 passes through the opening 27 to reach the center of the container 4 (shown in FIG. 3).

The first driving unit 29 includes a fluid pressure cylinder 31 and a piston rod 32 axially connected to a bracket 30 of a non-illustrated frame. However, the first driving unit 29 is not limited to such fluid pressure cylinder unit.

The guide member 3 is coupled to the rocking plate 14 to be slidable in the longitudinal direction. A second driving unit 34 is connected between the rocking plate 14 and a fixed plate 33 fastened to the rear side of the upper end 16 of the guide member 3, sliding the guide member 3.

With this embodiment, the second driving unit 34 includes a fluid pressure cylinder 35 and a piston rod 36 connected to the fixed plate 33. The driving unit 34 is not limited to such fluid pressure cylinder unit.

Figure 4:
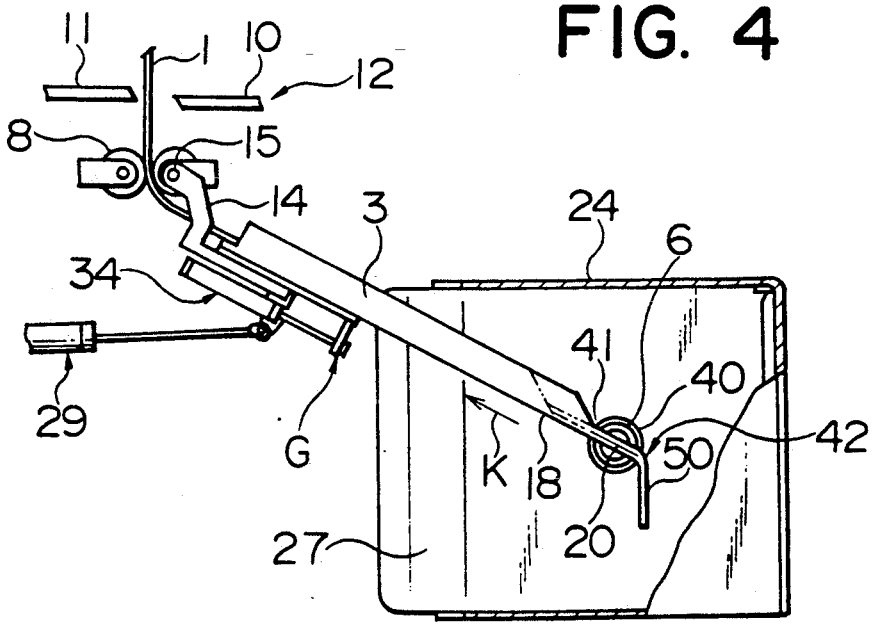
FIG. 4 is a view similar to FIG. 2, showing the tape just before it is wound.

Operation of the second driving unit 34 reciprocates the guide piece 20 between the position, which corresponds to the work position E of the lower end 18 of the guide member 3, and the position G where the guide piece 20 crosses the center of the container 4 shown in FIG. 4.

In this embodiment, the guide piece 20 is integral with the lower end of the conduit 17 of the guide member 3. A separate member may be attached to the bottom of the conduit 17 as a guide piece.

A spindle 6 is located near the holder 5 which is at the position shown in FIGS. 1 and 3. The spindle 6 is connected to a movable rod 38 such as a piston rod of a cylinder (not shown), and to a driving unit 39 such as a torque motor.

When the holder 5 is at the position shown in FIGS. 1 and 3, the spindle 6 advances into the center of the container 4 via the through hole 23, then returning to the standby position outside the container 4. The spindle 6 is reciprocated between these positions.

Figure 5:
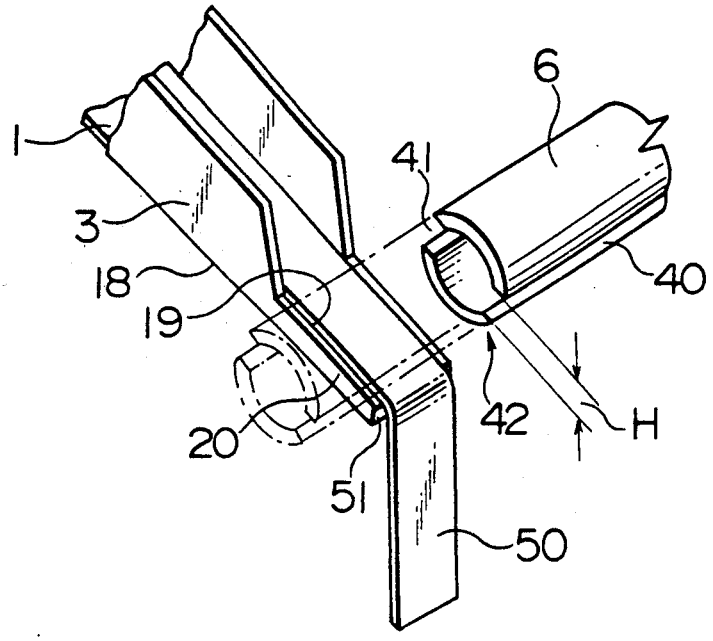
FIG. 5 is a perspective view showing the relationship between a spindle, a guide member and a leading edge of the tape.

The spindle 6 has two slits 40, 41 which are diagonally positioned, having a width H as shown in FIG. 5.

The slits 40, 41 have a length corresponding to a width of the whole containers 4 when a plurality of the tapes are simultaneously wound and stored in a plurality of containers 4. When only one tape is wound in one container 4, the length of the slits 40, 41 is substantially equal to the length between the front and rear surfaces of the container 4.

As shown in FIG. 4, the position of the slits 40, 41 of the spindle 6 at its standby position corresponds to the position G of the guide piece 20 which crosses the center of the container 4. The width H of the slits 40, 41 depends upon not only the thickness of both the guide piece 20 and the tape 1 but also upon a tolerance for inserting and withdrawing the guide piece 20 and the tape 1. The slits 40, 41 serve as a grip 42 for catching the tape 1 to be wound.

Figure 6:
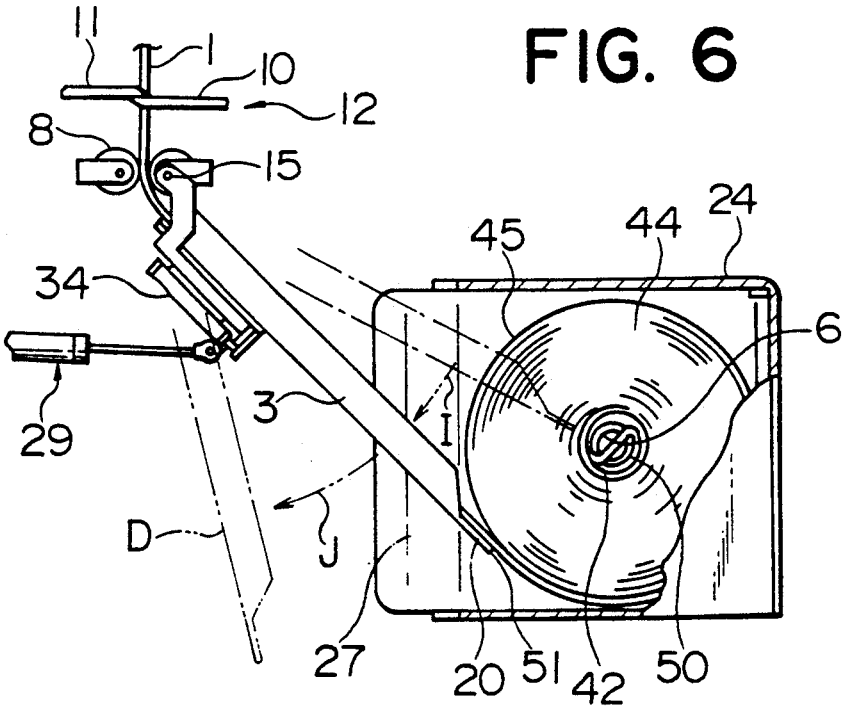
FIG. 6 is a view similar to FIG. 2, showing that the tape is fully wound.

The second driving unit 34 includes a stop mechanism, which moves the guide piece 20 to the position shown in FIG. 4 from the position shown in FIG. 3, returning the guide piece 20 to the position shown in FIG. 3 and stopping it there, after a leading edge 50 of the tape 1 is engaged by the grip 42 of the spindle 6. During tape winding, the spindle 6 keeps rotating so that upper leading surface 51 of the guide piece 20 is always in contact with an outermost layer 45 of wound layers 44, as shown in FIG. 6.

A detector 46 is connected to the shaft 15 for moving the guide member 3. The detector 46 detects a moving angle of the guide piece 20 which moves together with the guide member 3 in the directions I and J as the tape layers 44 increase. A detection signal of the detector 46 is transmitted to a controller 48, which emits a signal for controlling a controller 49 of the driving unit 39. The controller 49 controls the rotation speed of the spindle 6 to apply a uniform winding tension to the tape 1 throughout the winding work.

In a first step of operation, the tape 1 is fed by the feed rollers 7, 8 of the tape supply unit 2 as shown in FIGS.,1 and 2. The tape 1 is guided along the guide member 3 so that the leading edge 50 of the tape 1 goes beyond the lower end 18 of the guide member 3.

The leading edge 50 of the tape 1 should extend to the length L beyond the upper leading surface 51 of the guide piece 20. To maintain the length L, a detector 52 is located below the guide member 3 to detect the leading edge 50 of the tape 1.

Under this condition, the container 4 has been placed on the holder 5 at the standby position. The spindle 6 is also set at the standby position outside the container 4.

In a second step, the detector 52 emits the detection signal indicating presence of the leading edge 50. According to this signal, the tape supply unit 2 is stopped, and the first driving unit 29 connected to the guide member 3 is set in motion, moving the guide member 3 from the standby position D to the work position E.

The guide member 3 is at the position E of FIG. 3, so that the lower end 18 of the guide member 3 is advanced into the container 4 through the opening 27, reaching the through hole 23 at the center of the respective container 4.

Thereafter, the second driving unit 34 is operated to advance the guide piece 20, which crosses the through hole 23 of the container 4 as shown by a dash-dot-dash line in FIG. 3 and by a solid line in FIG. 4. Since part of the leading edge 50 of the tape 1 stays on the guide piece 20, the length L of the tape 1 extends downwardly from the guide piece 20 becomes shorter.

In a third step, the spindle 6 is advanced from the standby position to the tape winding position where the slits 40, 41 function as the grip 42 in the container 4.

As shown in FIG. 4, the guide piece 20 and the leading edge 50 of the tape 1 held in the guide grooves 19 are inserted into and sandwiched by the slits 40, 41.

FIG. 5 shows the positional relationship between the slits 40, 41, the guide piece 20 and the leading edge 50 in the guide groove 19, and the guide member 3. As described above, the width H of the slits 40, 41 is determined based on the thicknesses of the guide piece 20 and tape 1, and the tolerance necessary for insertion of the tape 1 and guide piece 3. The standby position of the spindle 6 is determined to be in alignment with the position of the guide piece 20 crossing the through hole 23 in the container 4. Therefore, when the spindle 6 is moved into the container 4 via the through hole 23, the guide piece 20 and tape 1 in the guide grooves 19 of the guide member 3 are received in the slits 40, 41 of the spindle 6. At this time, the leading edge 50 of the tape 1 extends downwardly from the slits 40, 41 as shown in FIGS. 4 and 5.

As a fourth step, the second driving unit 34 is restarted to withdraw the guide member 3 in the direction shown by an arrow K (FIG. 4) to the position shown by FIG. 3.

Backward movement of the guide member 3 is controlled by the stop mechanism of the second driving unit 34 so that the guide piece 20 comes off from the slits 40, 41 and the upper leading surface 51 of the guide member 3 comes into contact with the outermost layer of the tape 1 wound around the spindle 6.

The first driving unit 29 retreats the guide member 3 to the position shown in FIG. 3, and keeps the guide member 3 there. When a little pressure is however applied in the direction M, the first driving unit 29 gradually moves the guide member 3 in the direction M. The moving angle of the guide member 3 is detected by the detector 46. When the fluid pressure cylinder 31 is used, fluid is gradually applied.

The length L of the leading edge 50 of the tape 1 is determined so that only the leading edge 50 stays in the slits 40, 41 by its weight when the guide piece 20 of the guide member 3 is moved backward from the slits 40, 41 of the spindle 6 and that when the spindle 6 begins rotating, the leading edge 50 remains in the slits 40, 41 by the frictional resistance with these slits, and the tape 1 can be reliably wound around the spindle 6. This length L is detected by the detector 52.

When the guide pieces 20 are pulled out from the slits 40, 41 to reach the position where the guide pieces 20 do not interfere with the rotation of the spindle 6, the tape supply unit 2 and the driving unit 39 are operated according to the detection signal from the second driving unit 34. Thereafter, the tape 1 is wound around the spindle 6. Under this condition, the upper leading surface 51 of the guide pieces 20 presses the leading edge 50 of the tape 1 to the outer surface of the spindle 6.

As shown in FIG. 6, as the tape layers 44 increase, the guide piece 20, which is contacted with the outermost tape layer 45 via the upper leading surface 51, is gradually moved in the direction shown by arrows I and J. The moving angle of the guide member is detected by the detector 46. The rotation speed of the spindle 6 is controlled so that the tape 1 is wound with a substantially uniform tension from the beginning till the end of the winding operation.

The feeding speed of the tape supply unit 2 is controlled in accordance with the rotating speed of the spindle 6 so that the tape 1 can be wound with the substantially uniform tension.

The length of the tape 1 wound in the container 4 is easily detected based on the moving angle of the guide member 3 by the detector 46, or by an encoder or the like attached to the tape supply unit 2. Then, the driving unit 39 is stopped the cutter 12 is operated, the spindle 6 is retreated to the standby position, and the holder 5 is moved to the position to receive an empty container to replace the filled container 4 with the empty one. Thus, the tape winding procedure is completed.

In the foregoing embodiment, three separate tapes 1 are fed simultaneously. However, it is also possible to feed a wide tape while cutting it into thin tapes in the longitudinal direction.

According to this invention, when the leading edge of the tape is inserted into the container, the spindle is rotated to automatically wind the tape around its surface in the core-less form to the preset length. Therefore, the tape can be efficiently wound and stored in the container, thereby reducing the production cost of the tape.

The tape can be automatically wound in the coreless form in the container, being neatly arranged by application of substantially uniform tension.

As the tape layers increase, the rotation speed of the spindle is gradually reduced to apply the uniform tension to the tape throughout the winding process. Therefore, the tape can be neatly wound in the container, preventing deformation of the tape layers, and sticking out of the tape from the container.

The tape wound and stored in the container according to this invention will not be stained or damaged, and can be reliably stacked for storage and transportation, thereby facilitating the stock control.

What is claimed is:

1. An apparatus for winding and storing an elongate article in a container, comprising:

(a) an elongate article supply unit including at least one feed roller for feeding the elongate article in a feed direction and a cutter for cutting the elongate article;

(b) a guide member for guiding the elongate article, said guide member being rotatably connected to said elongate article supply unit via an upper portion of said guide member and including a guide piece which is slidable in the feed direction of said elongate article;

(c) a holder for supporting said container, said container having a through hole on at least one of front and rear surfaces and an opening on one side wall, said holder being positioned so that said opening of said container is kept within a moving path of a lower end of said guide member;

(d) a first driving unit connected to said guide member to reciprocate the lower end of said guide member between a standby position outside said container and a work position at least partially within said container where said lower end approaches a center line of said through hole through said opening;

(e) a second driving unit connected to said guide member to slide said guide piece of said guide member between the work position and a position where said guide piece crosses the center line of said through hole;

(f) a spindle located at a position corresponding to said through hole of said container supported on said holder, said spindle being reciprocated between a standby position outside said container and a position at least partially inside said container for winding said elongate article thereon in said container fed through said opening, and including a means for catching said elongate article carried on said guide piece of said guide member when said spindle is at the tape winding position and the guide piece has crossed the center line of the hole; and (g) a third driving unit for rotating said spindle when said guide piece withdraws to a stop position away from the center line of the hole where said guide piece does not interfere with said spindle, and for stopping said spindle when said elongate article is wound to a preset length.

2. An apparatus according to claim 1, wherein said second driving unit determines the stop position for said guide piece wherein said guide piece is always in contact with an outermost layer of layers of said elongate article on said spindle without interfering with said spindle, and comprising a detector connected to said guide member to detect a moving angle of said guide member in accordance with increase of a diameter of said tape layers, and said third driving unit includes control means for controlling the rotation speed of said spindle, according to a result detected by said detector, to apply a substantially uniform tension to said elongate article.

3. An apparatus for winding and storing an elongate article in a container, comprising:

a means for dispensing a length of said elongate article;

a guide member having a plate member pivotably attached to said means for dispensing and a guide piece slidably mounted to said plate member, said guide piece receiving said elongate article thereon;

holding means for positioning a container with an opening facing said guide piece;

a first driving means connected to said plate member for pivoting said plate member with respect to said means for dispensing, said guide piece and said opening sized and arranged for insertion of said guide piece into said opening upon pivoting of said plate member;

a second driving means connected to said guide piece, for alternately extending and retracting said guide piece with respect to said plate member, said guide piece adapted and arranged to support a portion of said elongate article to be coiled and to position said portion of said elongate article in registry with said hole within said container;

a spindle having a means for catching the portion of said elongate member, said spindle having means for allowing lateral movement from outside the container to insertion into said container through said hole to a position for catching said portion, said second driving means for retracting said guide piece away from said hole after catching by said means for catching; and a third driving unit for rotating the spindle to coil said elongate article.

4. The apparatus according to claim 3, wherein said means for catching comprises an open slot formed axially into said spindle.

5. The apparatus according to claim 4 further comprising control means for synchronizing the pivoting of said plate member and the extending of said guide piece and the inserting of said spindle, and the retracting of said guide piece for non-interference with said spindle during rotation thereof.

6. The apparatus according to claim 4, wherein said guide piece comprises a flat leading end with which said portion of said elongate article interfits within said open slot of said spindle during catching thereof.

7. The apparatus according to claim 3, wherein said second driving means comprises a pneumatic position actuator connected at one end to said guide piece and at a respective other end to said pate member.

* * * * *